US011202347B2

(12) United States Patent
Armstrong

(10) Patent No.: US 11,202,347 B2
(45) Date of Patent: Dec. 14, 2021

(54) OVER-THE-RANGE MICROWAVES HAVING ONE OR MORE AIRFLOW FEATURES

(71) Applicant: Haier US Appliance Solutions, Inc., Wilmington, DE (US)

(72) Inventor: James Lee Armstrong, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 186 days.

(21) Appl. No.: 16/550,624

(22) Filed: Aug. 26, 2019

(65) Prior Publication Data

US 2021/0068211 A1 Mar. 4, 2021

(51) Int. Cl.
*H05B 6/64* (2006.01)

(52) U.S. Cl.
CPC ..... *H05B 6/6423* (2013.01)

(58) Field of Classification Search
CPC ..... H05B 6/642; H05B 6/645; H05B 6/6405; H05B 6/6414; H05B 6/6423; H05B 6/6426; H05B 6/6429; H05B 6/6435; H05B 6/6447; H05B 6/6461; H05B 6/6473; H05B 6/6485; H05B 6/668; H05B 6/6424; F24C 15/006; F24C 15/008; F24C 15/02; F24C 15/023; F24C 15/024; F24C 15/028; F24C 15/04; F24C 15/20; F24C 15/2021; F24C 15/2028; F24C 15/2042; F24C 15/2064; F24C 15/2071
USPC ..... 219/739, 740, 756, 757
See application file for complete search history.

(56) References Cited

U.S. PATENT DOCUMENTS

| | | | | |
|---|---|---|---|---|
| 5,235,962 | A | 8/1993 | Doty et al. | |
| 6,621,058 | B1 | 9/2003 | Kim | |
| 6,851,581 | B2 | 2/2005 | Perucca et al. | |
| 6,857,439 | B1 | 2/2005 | Perruca et al. | |
| 7,183,529 | B2 | 2/2007 | Baek et al. | |
| 7,348,527 | B2 | 3/2008 | Braunisch et al. | |
| 8,711,321 | B2 | 4/2014 | Dunn et al. | |
| 2007/0102426 | A1* | 5/2007 | Braunisch ..... | H05B 6/6423 219/757 |
| 2007/0158330 | A1* | 7/2007 | Kim ..... | F24C 15/006 219/400 |

(Continued)

FOREIGN PATENT DOCUMENTS

| | | | |
|---|---|---|---|
| CN | 2513031 | Y | 9/2002 |
| CN | 1278074 | C | 10/2006 |

(Continued)

*Primary Examiner* — Hung D Nguyen
(74) *Attorney, Agent, or Firm* — Dority & Manning, P.A.

(57) ABSTRACT

A microwave appliance, as provided herein, may include a cabinet, a door, and an air handler. The cabinet may extend in a lateral direction between a first side end and a second side end. The door may be movably mounted to the cabinet at the first side end or the second side end to move between an open position permitting access to a cooking chamber and a closed position restricting access to the cooking chamber. The door may include a peripheral frame and a front window bounded by the peripheral frame. The peripheral frame may define an air inlet and an air outlet downstream from the air inlet. The air outlet may be defined below the front window. The air handler may be mounted within the door in fluid communication between the air inlet and the air outlet to motivate an airflow therethrough.

18 Claims, 9 Drawing Sheets

(56) References Cited

U.S. PATENT DOCUMENTS

| | | | | |
|---|---|---|---|---|
| 2008/0102743 | A1 | 5/2008 | Williams | |
| 2010/0181308 | A1* | 7/2010 | Lee | F24C 15/006 219/757 |
| 2018/0003395 | A1 | 1/2018 | Reinhard-Herrscher et al. | |
| 2018/0372331 | A1 | 12/2018 | Serabatir et al. | |

FOREIGN PATENT DOCUMENTS

| | | | | |
|---|---|---|---|---|
| CN | 205402847 | U | 7/2016 | |
| EP | 2418315 | A2 | 2/2012 | |
| JP | 2019-152345 | A * | 9/2019 | F24C 15/02 |
| WO | WO2017134213 | A1 | 8/2017 | |
| WO | WO2017209882 | A1 | 12/2017 | |

* cited by examiner

OVER-THE-RANGE MICROWAVES HAVING ONE OR MORE AIRFLOW FEATURES

FIELD OF THE INVENTION

The present subject matter relates generally to microwave appliances, and more particularly to an over-the-range microwave appliance mountable over a cooktop or range and having features for managing airflows through the microwave appliance.

BACKGROUND OF THE INVENTION

Cooktop or range appliances generally include heating elements for heating cooking utensils, such as pots, pans, and griddles. A variety of configurations can be used for the heating elements located on the cooking surface of the cooktop. The number of heating elements or positions available for heating on the cooktop can include, for example, four, six, or more depending upon the intended application and preferences of the buyer. These heating elements can vary in size, location, and capability across the appliance.

Often, a separate appliance, such as a microwave oven appliance (i.e., microwave appliance), is mounted directly above a cooktop or range appliance. Microwave appliances configured for this arrangement are generally referred to as over-the-range (OTR) microwave appliances. OTR microwave appliances (i.e., OTR microwaves) have become especially popular in consumer homes, apartments, and other residential settings. As with other microwave appliances, OTR microwave appliances generally include a cabinet that defines a cooking chamber for receipt of food items for cooking. In order to provide selective access to the cooking chamber and to contain food particles and cooking energy (e.g. microwaves) during a cooking operation, a door is further included that is typically pivotally mounted to the cabinet. Unlike other microwave appliances, though, OTR microwave appliances must often contend with heat and exhaust (e.g., steam, smoke, etc.) generated by the cooktop or range appliance mounted below the OTR microwave appliance. Some existing OTR microwave appliances have a vent system for directing or motivating exhaust through the cabinet (e.g., around the cooking chamber) and out of an air outlet defined by an outer wall of the cabinet.

Nonetheless, existing systems leave much to be desired. In particular, the extreme environment near a cooktop appliance may risk damaging or impeding the use of an OTR microwave appliance. In some instances, a portion of the door or a user interface of an OTR microwave appliance may be rendered unusable. For instance, food or fluid (e.g., heated air or steam) may obscure the door or user interface. In some cases, the area through the door or the user interface may be partially or completely blocked from view. In other cases, heat or exhaust fumes may be directed to the user interface or controller of the OTR microwave appliance, increasing the potential failure of the OTR appliance. Moreover, heat from the cooktop appliance may be directed at or absorbed by the door (e.g., at a door handle) of the OTR microwave appliance, which may damage the door or make it difficult for a user to access the door.

As a result, improved OTR microwave appliances are needed for addressing heat or exhaust fluid from a cooktop appliance. In particular, it may be advantageous to provide an OTR microwave appliance configured to protect the door, user interface, or one or more electronic components from the extreme environment near or above a cooktop appliance.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a microwave appliance is provided. The microwave appliance may include a cabinet, a door, and an air handler. The cabinet may extend in a lateral direction between a first side end and a second side end. The cabinet may define a cooking chamber. The door may be movably mounted to the cabinet at the first side end or the second side end to move between an open position permitting access to the cooking chamber and a closed position restricting access to the cooking chamber. The door may include a peripheral frame and a front window bounded by the peripheral frame. The peripheral frame may define an air inlet above a cooktop appliance and an air outlet downstream from the air inlet. The air outlet may be defined below the front window along a vertical direction. The air handler may be mounted within the door in fluid communication between the air inlet and the air outlet to motivate an airflow therethrough. The air outlet may define an airflow curtain path extending outward from the cabinet in front of the door.

In another exemplary aspect of the present disclosure, a microwave appliance is provided. The microwave appliance may include a cabinet, a door, and an air handler. The cabinet may extend in a lateral direction between a first side end and a second side end. The cabinet may define a cooking chamber. The door may be movably mounted to the cabinet in front of the cooking chamber to move between an open position permitting access to the cooking chamber and a closed position restricting access to the cooking chamber. The door may include a peripheral frame and a front window bounded by the peripheral frame. The peripheral frame may define an air inlet, a first air outlet, and a second air outlet. The first air outlet may be defined downstream from the air inlet and below the front window along the vertical direction. The second air outlet may be defined downstream from the air inlet and above the first air outlet along a vertical direction. The air handler may be mounted within the peripheral frame in fluid communication between the air inlet and the first air outlet to motivate an airflow therethrough. The first air outlet may define an airflow curtain path may extend outward from the cabinet in front of the front window. The second air outlet may define a coolant airflow path extending from a position forward from the front window and therealong.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
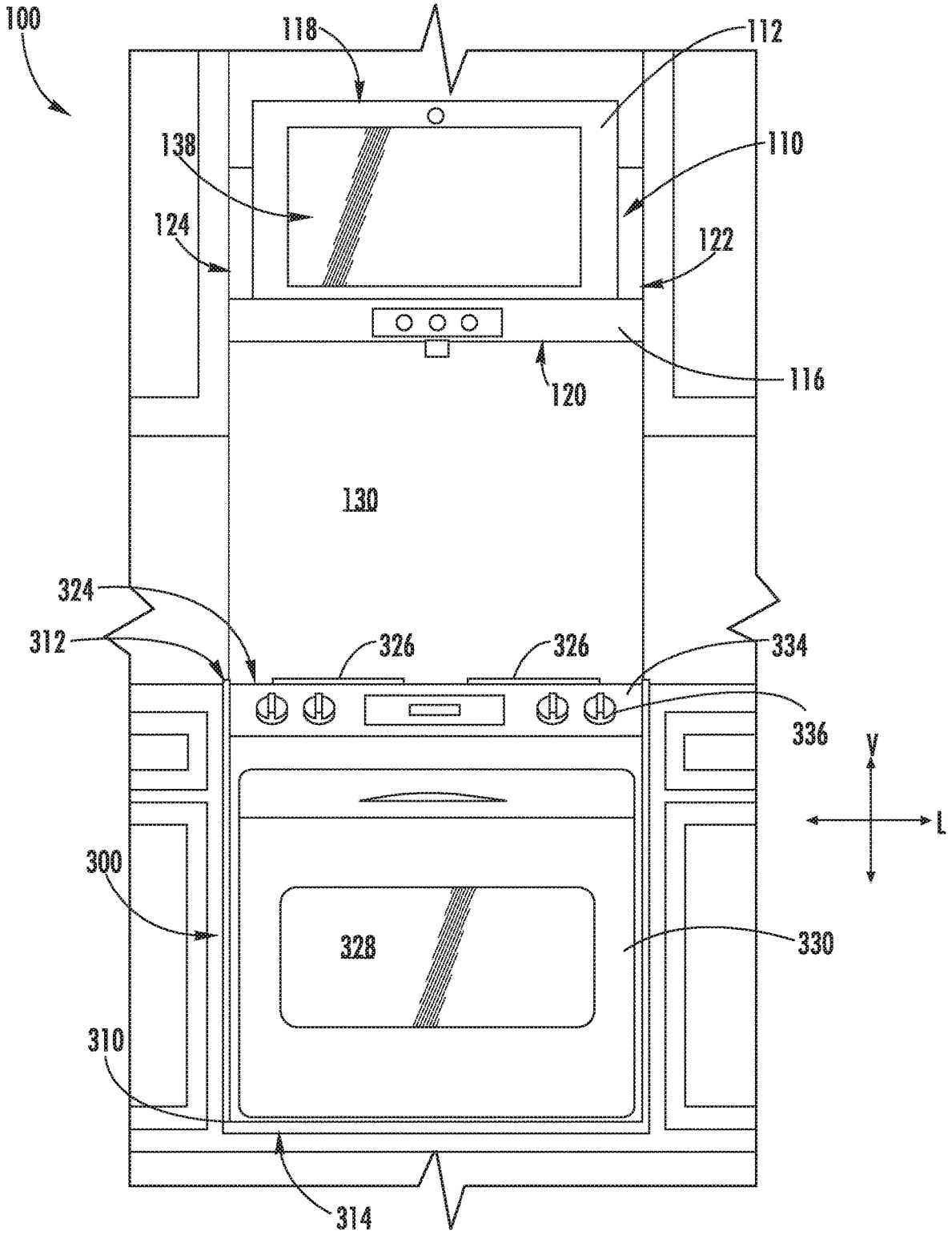
FIG. 1 provides a front perspective view of a system, including a microwave appliance, according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
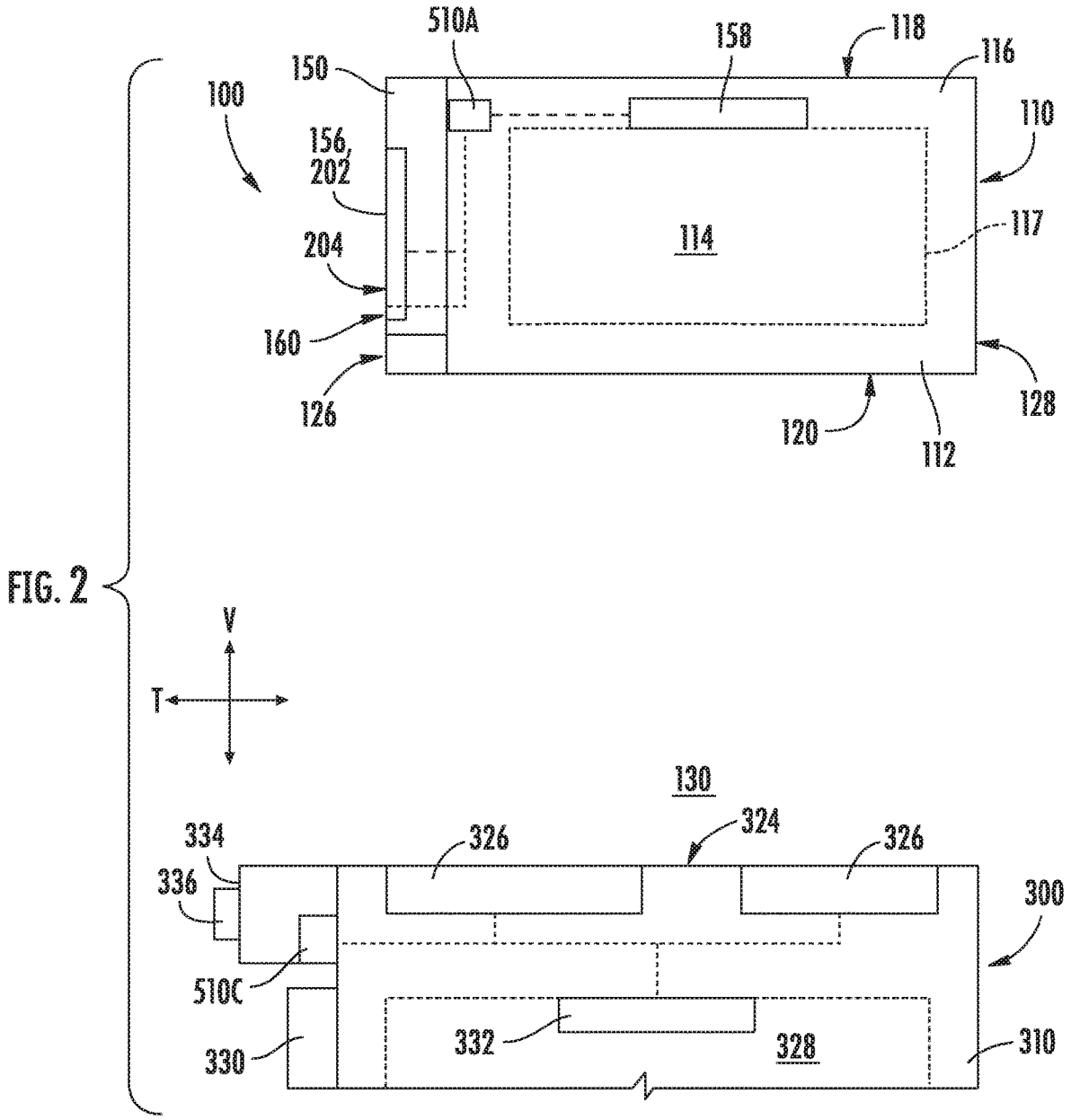
FIG. 2 provides a side schematic view of the exemplary system of FIG. 1.
Figure 3:
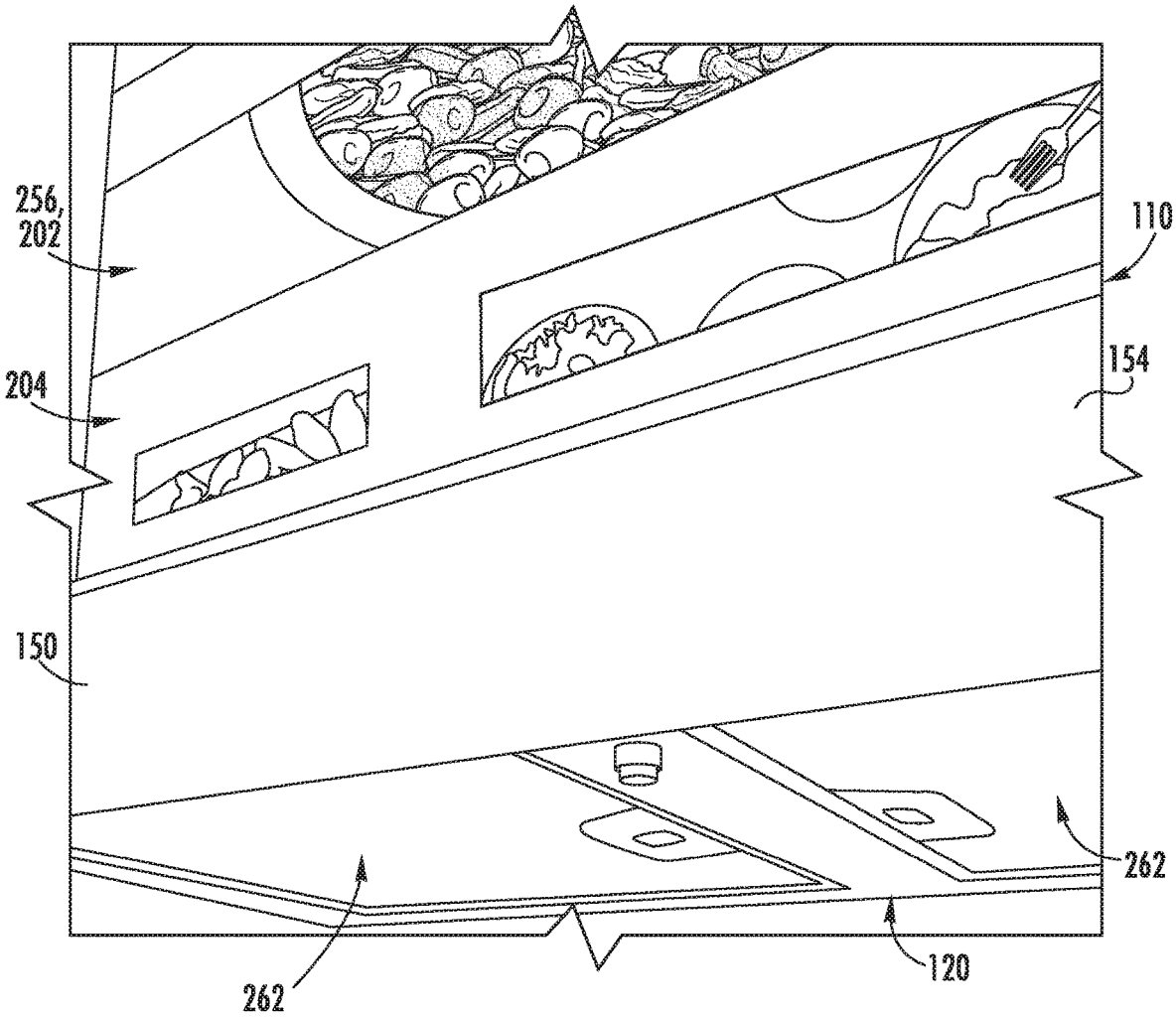
FIG. 3 provides a bottom perspective view of a portion of the exemplary system of FIG. 1.

Turning to the figures, FIGS. 1 through 3 provide various views of a system 100 according to exemplary embodiments of the present disclosure. System 100 generally includes an over-the-range (OTR) microwave appliance 110 that can be positioned or mounted above a cooktop appliance 300.

As shown, cooktop appliance 300 defines a vertical direction V, a lateral direction L, and a transverse direction T, for example, at a cabinet 310. The vertical, lateral, and transverse directions are mutually perpendicular and form an orthogonal direction system. As shown, cooktop appliance 300 extends along the vertical direction V between a top portion 312 and a bottom portion 314; along the lateral direction L between a left side portion and a right side portion; and along the traverse direction T between a front portion and a rear portion.

Cooktop appliance 300 can include a chassis or cabinet 310 and a cooktop surface 324 having one or more heating elements 326 for use in, for example, heating or cooking operations. In exemplary embodiments, cooktop surface 324 is constructed with ceramic glass. In other embodiments, however, cooktop surface 324 may include of another suitable material, such as a metallic material (e.g., steel) or another suitable non-metallic material. Heating elements 326 may be various sizes and may employ any suitable method for heating or cooking an object, such as a cooking utensil (not shown), and its contents. In some embodiments, for example, heating element 326 uses a heat transfer method, such as electric coils or gas burners, to heat the cooking utensil. In other embodiments, however, heating element 326 uses an induction heating method to heat the cooking utensil directly. In turn, heating element 326 may include a gas burner element, resistive heat element, radiant heat element, induction element, or another suitable heating element.

In some embodiments, cooktop appliance 300 includes an insulated cabinet 310 that defines a cooking chamber 328 selectively covered by a door 330. One or more heating elements 332 (e.g., top broiling elements or bottom baking elements) may be enclosed within cabinet 310 to heat cooking chamber 328. Heating elements 332 within cooking chamber 328 may be provided as any suitable element for cooking the contents of cooking chamber 328, such as an electric resistive heating element, a gas burner, a microwave element, a halogen element, etc. Thus, cooktop appliance 300 may be referred to as an oven range appliance. As will be understood by those skilled in the art, cooktop appliance 300 is provided by way of example only, and the present subject matter may be used in the context of any suitable cooking appliance, such as a double oven range appliance or a standalone cooktop (e.g., fitted integrally with a surface of a kitchen counter). Thus, the example embodiments illustrated in figures are not intended to limit the present subject matter to any particular cooking chamber or heating element configuration, except as otherwise indicated.

As illustrated, a user interface panel 334 may be provided on cooktop appliance 300. Although shown at front portion of cooktop appliance 300, another suitable location or structure (e.g., a backsplash) for supporting user interface panel 334 may be provided in alternative embodiments. In some embodiments, user interface panel 334 includes input components or controls 336, such as one or more of a variety of electrical, mechanical, or electro-mechanical input devices. Controls 336 may include, for example, rotary dials, knobs, push buttons, and touch pads. A controller 510C is in communication with user interface panel 334 and controls 336 through which a user may select various operational features and modes and monitor progress of cooktop appliance 300. In additional or alternative embodiments, user interface panel 334 includes a display component, such as a digital or analog display in communication with a controller 510C and configured to provide operational feedback to a user. In certain embodiments, user interface panel 334 represents a general purpose I/O ("GPIO") device or functional block.

As shown, controller 510C is communicatively coupled (i.e., in operative communication) with user interface panel 334 and its controls 336. Controller 510C may also be communicatively coupled with various operational components of cooktop appliance 300 as well, such as heating elements (e.g., 326, 332), sensors, etc. Input/output ("I/O") signals may be routed between controller 510C and the various operational components of cooktop appliance 300. Thus, controller 510C can selectively activate and operate these various components. Various components of cooktop appliance 300 are communicatively coupled with controller 510C via one or more communication lines such as, for example, conductive signal lines, shared communication busses, or wireless communications bands.

In some embodiments, controller 510C includes one or more memory devices and one or more processors. The processors can be any combination of general or special purpose processors, CPUs, or the like that can execute programming instructions or control code associated with operation of cooktop appliance 300. The memory devices (i.e., memory) may represent random access memory such as DRAM or read only memory such as ROM or FLASH. In one embodiment, the processor executes programming instructions stored in memory. The memory may be a separate component from the processor or may be included onboard within the processor. Alternatively, controller 510C may be constructed without using a processor, for example, using a combination of discrete analog or digital logic circuitry (such as switches, amplifiers, integrators, comparators, flip-flops, AND gates, and the like) to perform control functionality instead of relying upon software.

In certain embodiments, controller 510C includes a network interface such that controller 510C can connect to and communicate over one or more networks with one or more network nodes. Controller 510C can also include one or more transmitting, receiving, or transceiving components for transmitting/receiving communications with other devices communicatively coupled with cooktop appliance 300. Additionally or alternatively, one or more transmitting, receiving, or transceiving components can be located off board controller 510C. Generally, controller 510C can be positioned in any suitable location throughout cooktop appliance 300. For example, controller 510C may be located proximate user interface panel 334 toward front portion of cooktop appliance 300. In optional embodiments, controller 510C is in operable communication with a controller 510A of microwave appliance (e.g., through one or more wired or wireless channels).

As noted above, microwave appliance 110 may be positioned or mounted above cooktop appliance 300 (e.g., as an OTR microwave). Specifically, an insulated cabinet 112 of microwave appliance 110 may be positioned above cooktop appliance 300 along the vertical direction V. As shown, microwave appliance 110 includes a plurality of outer walls (e.g., outer casing 116 of cabinet 112) and a door 150. When assembled, microwave appliance 110 generally extends along the vertical direction V between a top end 118 and a bottom end 120; along the lateral direction L between a first side end 122 and a second side end 124; and along the transverse direction T between a front end 126 and a rear end 128. In some embodiments, outer casing 116 is spaced apart from cooktop surface 324 along the vertical direction V. An open region 130 may thus be defined along the vertical direction V between cooktop surface 324 and bottom end 120. Although a generally rectangular shape is illustrated, any suitable shape or style may be adapted to form the structure of outer casing 116. Within outer casing 116, an internal liner 117 of cabinet 112 defines a cooking chamber 114 for receipt of food items for cooking.

Microwave appliance 110 includes a door 150 that is movably mounted (e.g., rotatably attached) to cabinet 112 in order to permit selective access to cooking chamber 114. Specifically, door 150 can move between an open position (not pictured) and a closed position (e.g., FIG. 1). The open position permits access to cooking chamber 114 while the closed position restricts access to cooking chamber 114. Except as otherwise indicated, with respect to the directions (e.g., the vertical direction V, the lateral direction L, and the transverse direction T), the door 150 is described in the closed position.

A handle 152 may be mounted to or formed on door 150 (e.g., at a peripheral frame 154 of door 150) to assist a user with opening and closing door 150. As an example, a user can pull on handle 152 to open or close door 150 and access or cover cooking chamber 114. Additionally or alternatively, microwave appliance 110 may include a door release button (not pictured) that disengages or otherwise pushes open door 150 when depressed.

In some embodiments, door 150 includes a peripheral frame 154 that bounds or supports a front window 156. Generally, front window 156 may be a translucent or transparent panel (e.g., formed from a transparent glass, plastic, etc.) and can provide for viewing the contents of cooking chamber 114 when door 150 is closed (i.e., in the closed position). Optionally, front window 156 may further assist with insulating cooking chamber 114.

As shown, peripheral frame 154 may frame front window 156 in the transverse direction T and lateral direction L. In other words, peripheral frame 154 may extend about a perimeter of front window 156 (e.g., at a position forward from front window 156). At least a portion of peripheral frame 154 may hold, for instance, a front panel of front window 156 in place (e.g., such that movement of front window 156 in the transverse direction T is restricted).

Microwave appliance 110 is generally configured to heat articles (e.g., food or beverages) within cooking chamber 114 using electromagnetic radiation. Microwave appliance 110 may include various components which operate to produce the electromagnetic radiation, as is generally understood. For example, microwave appliance 110 may include a heating assembly 158 having a magnetron (e.g., a cavity magnetron), a high voltage transformer, a high voltage capacitor, and a high voltage diode, as is understood. The transformer may provide energy from a suitable energy source (such as an electrical outlet) to the magnetron. The magnetron may convert the energy to electromagnetic radiation, specifically microwave radiation. The capacitor generally connects the magnetron and transformer, such as via high voltage diode, to a chassis. Microwave radiation produced by the magnetron may be transmitted through a waveguide to cooking chamber 114.

The structure and intended function of microwave ovens or appliances are generally understood by those of ordinary skill in the art and are not described in further detail herein. According to alternative embodiments, microwave appliance 110 may include one or more heating elements, such as electric resistance heating elements, gas burners, other microwave heating elements, halogen heating elements, or suitable combinations thereof, are positioned within cooking chamber 114 for heating cooking chamber 114 and food items positioned therein.

As illustrated, a user interface panel 160 may be provided on microwave appliance 110. In some embodiments, user interface panel 160 includes input components or controls 162, such as one or more of a variety of electrical, mechanical, or electro-mechanical input devices. Controls 162 may include, for example, rotary dials, knobs, push buttons, and touch pads. A controller 510A is in communication with user interface panel 160 and controls 162 through which a user may select various operational features and modes and monitor progress of microwave appliance 110. In additional or alternative embodiments, user interface panel 160 includes a display component, such as a digital or analog display in communication with a controller 510A and configured to provide operational feedback to a user. In certain embodiments, user interface panel 160 represents a general purpose I/O ("GPIO") device or functional block.

In some embodiments, controller 510A is communicatively coupled (i.e., in operative communication) with user interface panel 160 and its controls 162. Controller 510A may also be communicatively coupled with various operational components of microwave appliance 110 as well, such as heating assembly 158, sensors, etc. Input/output ("I/O") signals may be routed between controller 510A and the various operational components of microwave appliance 110. Thus, controller 510A can selectively activate and operate these various components. Various components of microwave appliance 110 are communicatively coupled with controller 510A via one or more communication lines such as, for example, conductive signal lines, shared communication busses, or wireless communications bands.

In some embodiments, controller 510A includes one or more memory devices and one or more processors. The processors can be any combination of general or special purpose processors, CPUs, or the like that can execute programming instructions or control code associated with operation of microwave appliance 110. The memory devices (i.e., memory) may represent random access memory such as DRAM or read only memory such as ROM or FLASH. In one embodiment, the processor executes programming instructions stored in memory. The memory may be a separate component from the processor or may be included onboard within the processor. Alternatively, controller 510A may be constructed without using a processor, for example, using a combination of discrete analog or digital logic circuitry (such as switches, amplifiers, integrators, comparators, flip-flops, AND gates, and the like) to perform control functionality instead of relying upon software.

In certain embodiments, controller 510A includes a network interface such that controller 510A can connect to and communicate over one or more networks with one or more network nodes. Controller 510A can also include one or more transmitting, receiving, or transceiving components for transmitting/receiving communications with other devices communicatively coupled with microwave appliance 110. Additionally or alternatively, one or more transmitting, receiving, or transceiving components can be located off board controller 510A. Generally, controller 510A can be positioned in any suitable location throughout microwave appliance 110. For example, controller 510A may be located proximate user interface panel 160 toward front portion of microwave appliance 110.

In some embodiments, cooktop controller 510C is provided as or as part of controller 510A. In alternative embodiments, cooktop controller 510C is a discrete unit in selective operable communication with controller 510A (e.g., through one or more wired or wireless channels).

In optional embodiments, an image monitor 202 is provided above cooktop surface 324 (e.g., along the vertical direction V). For instance, image monitor 202 may be mounted to or supported on door 150 (e.g., directly above cooktop surface 324) proximal to the front end 126. Generally, image monitor 202 may be any suitable type of mechanism for visually presenting a digital (e.g., interactive) image. For example, image monitor 202 may be a liquid crystal display (LCD), a plasma display panel (PDP), a cathode ray tube (CRT) display, etc. Thus, image monitor 202 includes an imaging surface 204 (e.g., screen or display panel) at which the digital image is presented or displayed as an optically-viewable picture (e.g., static image or dynamic video) to a user. In certain embodiments, image monitor 202 is mounted behind front window 156. For example, front window 156 may be positioned across or over an imaging surface 204 of image monitor 202. In some such embodiments, front window 156 is mounted within or supported on door 150 forward from imaging surface 204 along the transverse direction T (e.g., as defined when door 150 is in the closed position).

The optically-viewable picture at the imaging surface 204 may correspond to any suitable signal or data received or stored by microwave appliance 110 (e.g., at controller 510A). As an example, image monitor 202 may present recipe information in the form of viewable text or images. As another example, image monitor 202 may present a remotely captured image, such as a live (e.g., real-time) dynamic video stream received from a separate user or device. As yet another example, image monitor 202 may present a graphical user interface (GUI) (e.g., as or as part of user interface 160) that allows a user to select or manipulate various operational features of microwave appliance 110. During use of such GUI embodiments, a user may engage, select, or adjust the image presented at image monitor 202 through any suitable input, such as gesture controls detected through a camera assembly, voice controls detected through one or more microphones, associated touch panels (e.g., capacitance or resistance touch panels) or sensors overlaid across imaging surface 204, etc.

As illustrated, the imaging surface 204 generally faces, or is directed away from, cooktop surface 324. In particular, the imaging surface 204 is directed toward the area forward from the cooktop appliance 300 (e.g., when door 150 is in the closed position). During use, a user standing in front of cooktop appliance 300 may thus see the optically-viewable picture (e.g., recipe, dynamic video stream, graphical user interface, etc.) displayed at the imaging surface 204.

Turning now to FIGS. 4 through 8, various views are provided of microwave appliance 110 according to exemplary embodiments of the present disclosure. As shown, cabinet 112 extends in the vertical direction V from a top end 118 to a bottom end 120, the transverse direction T between a front surface 127 and the rear end 128, and in the lateral direction L from the first side end 122 to a second side end 124. One or more air inlets 210 and air outlets 212, 214 may be defined by microwave appliance 110 (e.g., through door 150). Moreover, an air handler 216 (e.g., one or more fans or blowers) may be provided (e.g., in fluid communication with or within door 150) to motivate an airflow through one or more passages or cavities defined between the air inlet 210 and the air outlets 212, 214. Thus, air handler 216 may be mounted (e.g., within door 150) downstream from at least one air inlet 210 and upstream from at least one air outlet 212 or 214.

In certain embodiments, air handler 216 includes a plurality of fans (e.g., axial fans 286, 288) spaced apart from each other. For instance, the plurality of fans 286, 288 may be mounted within peripheral frame 154 at discrete locations along the lateral direction L. In other words, each fan 286, 288 may be spaced apart from one or more adjacent fans 286, 288 along the lateral direction L. Additionally or alternatively, the plurality of fans 286, 288 may be mounted within peripheral frame 154 above front window 156.

In some embodiments, an air inlet 210 is defined at a position proximal to the top end 118 (e.g., above front window 156 relative to the vertical direction V), while one or more air outlets 212, 214 are defined at a position (e.g., discrete positions) proximal to the front end 126. Additionally or alternatively, the air inlet 210 may be defined through the door 150 forward from outer casing 116) relative to the transverse direction T.

Figure 5:
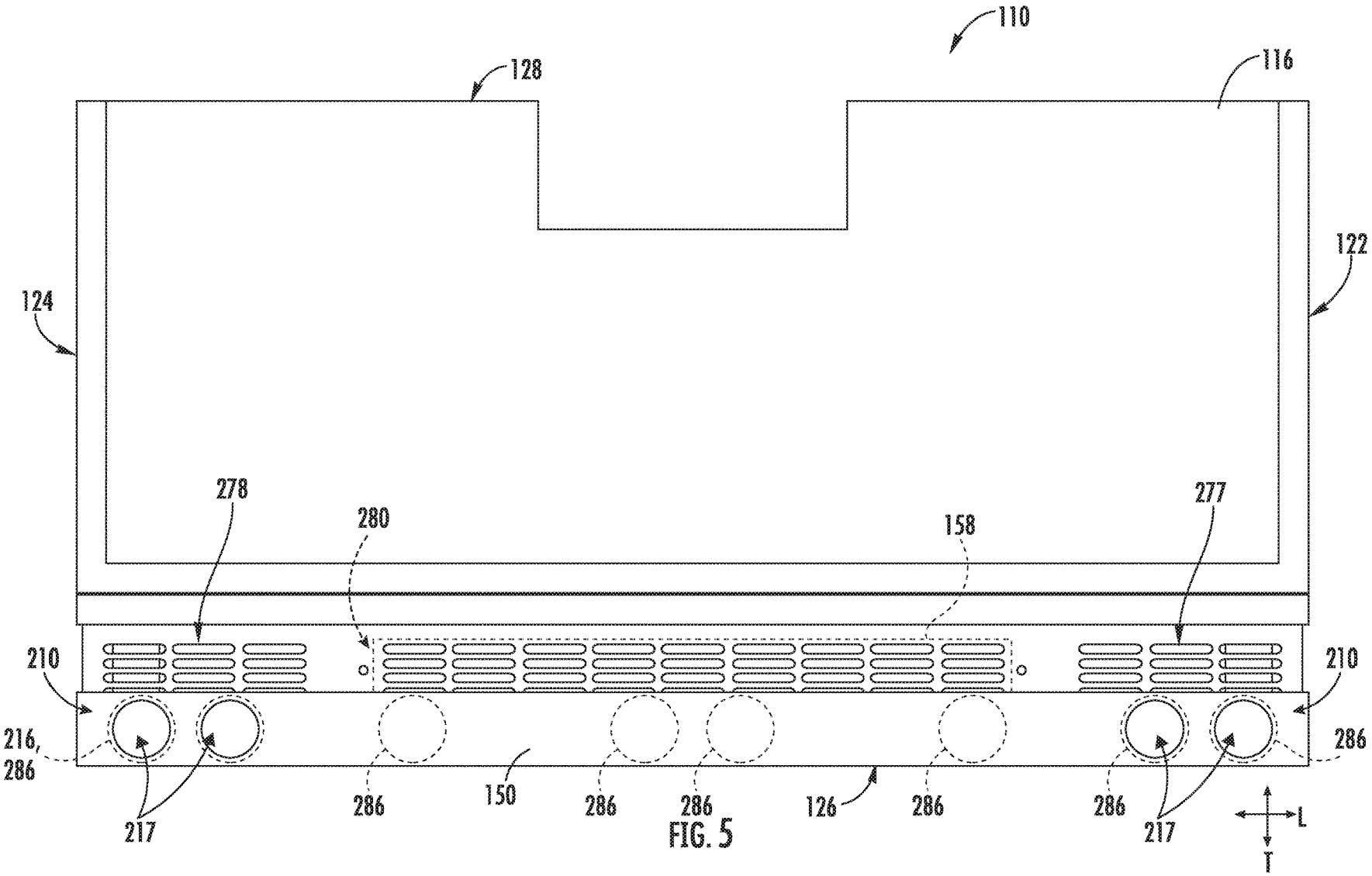
FIG. 5 provides a top perspective view of a microwave appliance to exemplary embodiments of the present disclosure.
Figure 7:
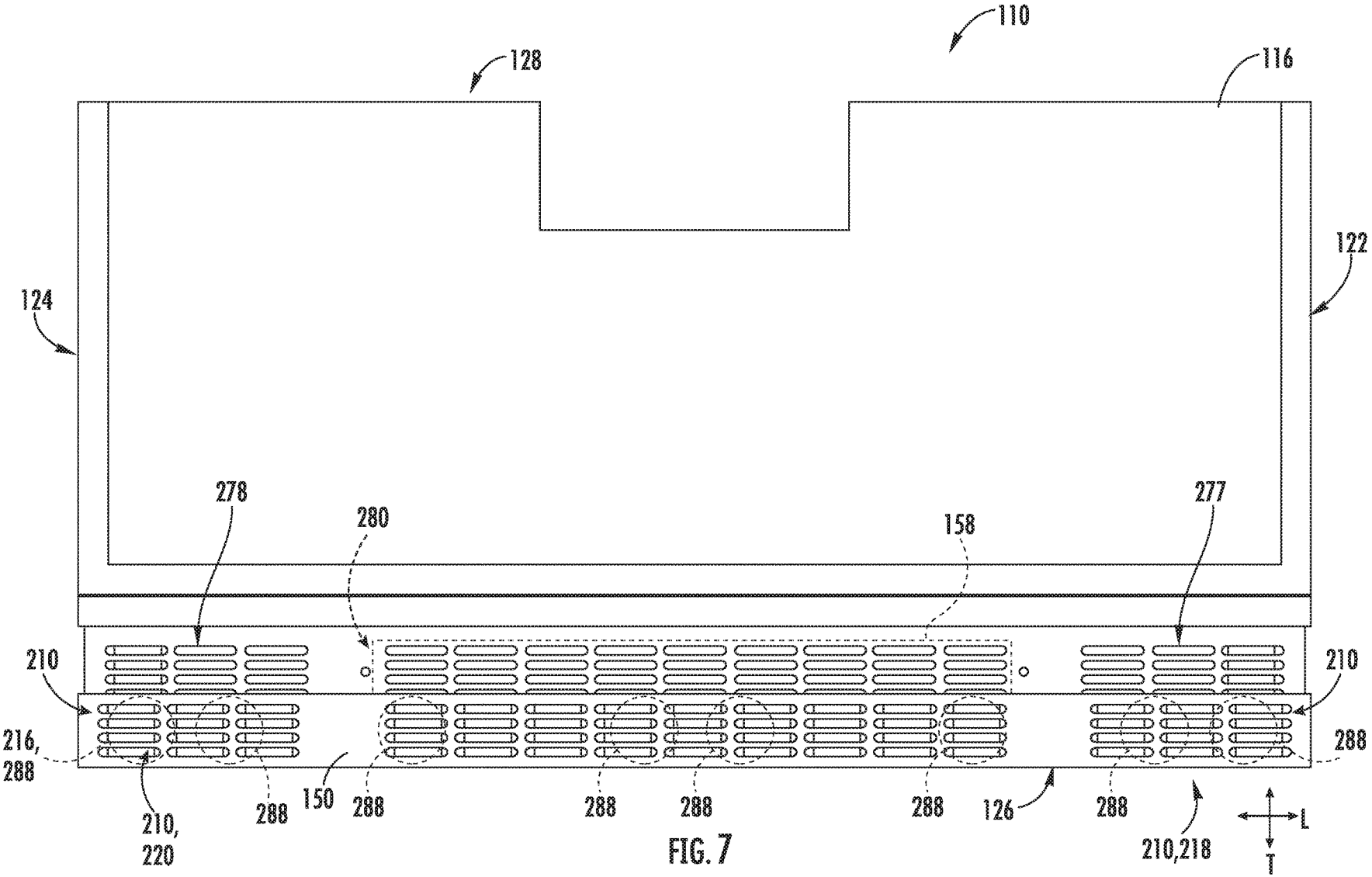
FIG. 7 provides a top perspective view of a microwave appliance to exemplary embodiments of the present disclosure.

Turning especially to FIGS. 5 and 7, air inlet 210 may include a plurality of inlet apertures defined through a top wall of outer casing 116. As an example, such as that illustrated in FIG. 5, air inlet 210 may include a plurality of discrete axial apertures 217. Each axial aperture 217 may be laterally spaced apart from each other. Optionally, one or more axial apertures 217 may be vertically aligned with a corresponding fan 286 of the plurality of fans 286. As another example, such as that illustrated in FIG. 7, air inlet 210 may include a first aperture set 218. Optionally, first aperture set 218 may be spaced apart from a second aperture set 220 (e.g., along the lateral direction L). First aperture set 218 may be proximal to first side end 122 and second aperture set 220 may be proximal to second side end 124. Thus, air may be drawn into hood casing 116 from both first side end 122 and second side end 124. Optionally, additional apertures or aperture sets may be defined between first aperture set 218 and second aperture set 220.

Figure 6:
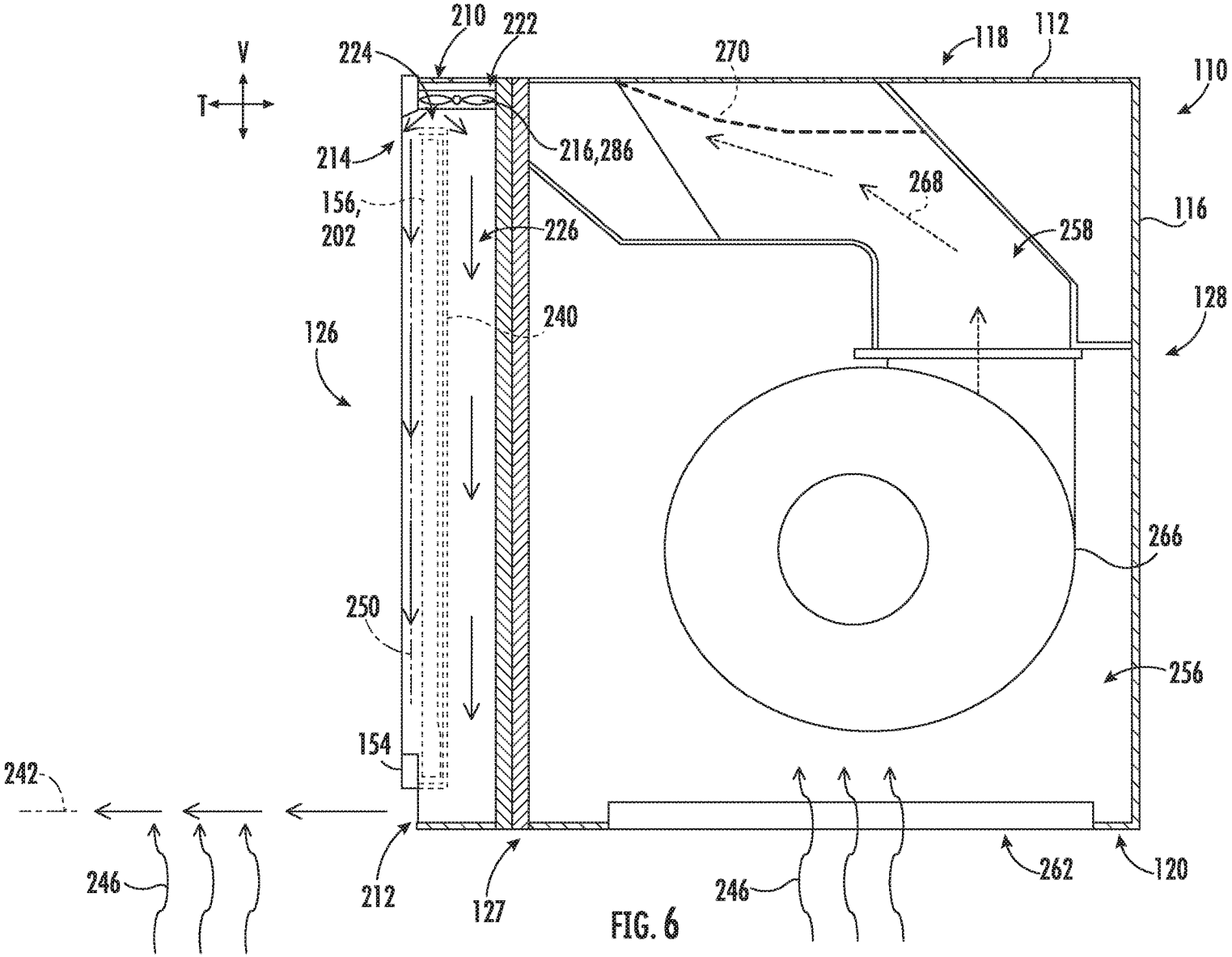
FIG. 6 provides a cross-sectional schematic view of a microwave appliance according to exemplary embodiments of the present disclosure.
Figure 8:
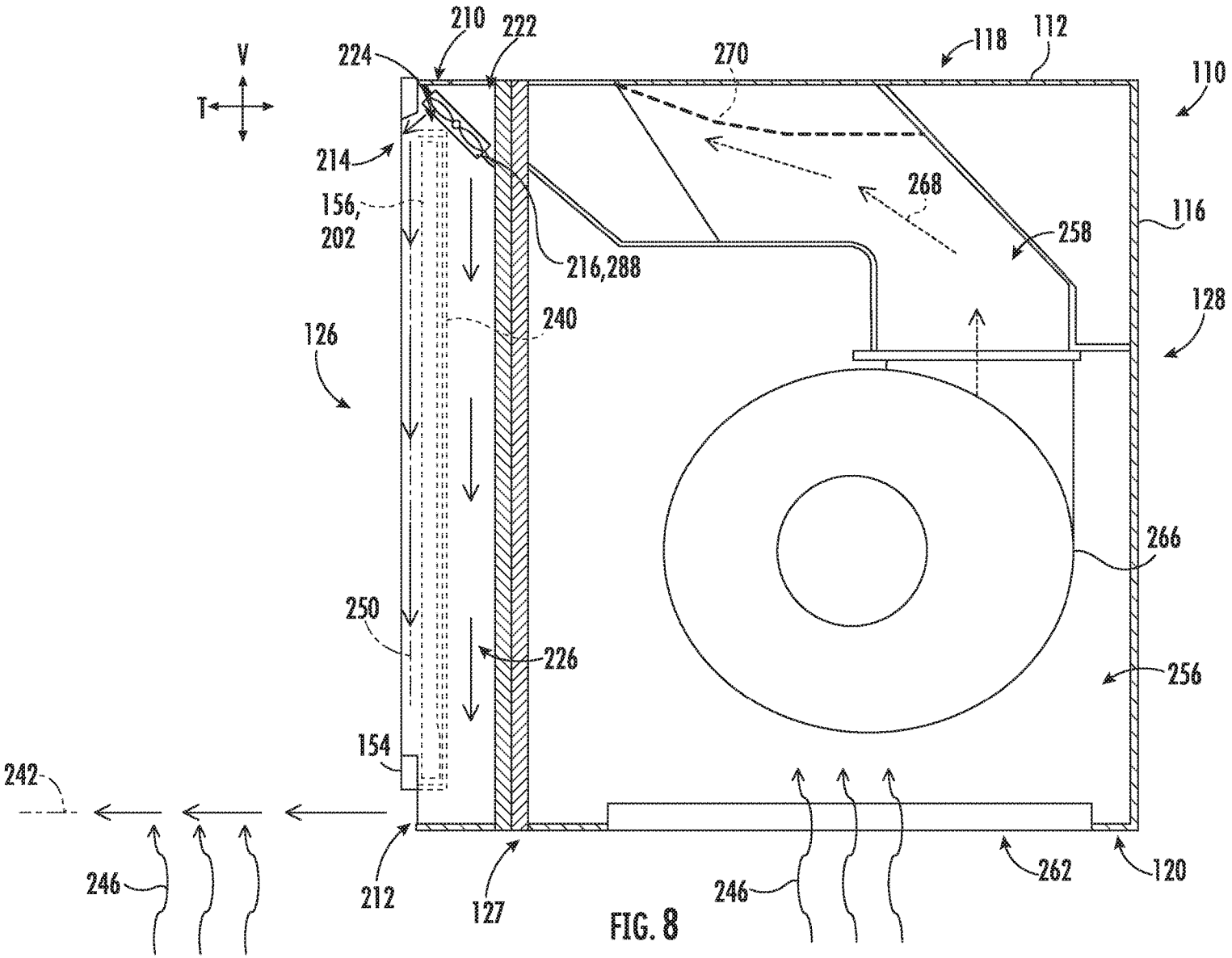
FIG. 8 provides a cross-sectional schematic view of a microwave appliance according to exemplary embodiments of the present disclosure.

Turning especially to FIGS. 6 and 8, one or more air passages are defined within microwave appliance 110 in fluid communication between air inlet 210 and one or more air outlets 212, 214. As an example, an air intake passage 222 may be defined within door 150 downstream from air inlet 210. Specifically, air intake passage 222 may extend from air inlet 210 through a portion of peripheral frame 154 above front window 156 and forward from outer casing 116 (e.g., at the front surface 127).

Within door 150, one or more outlet passages 224, 226 are defined downstream of intake passage 222. As an example, a first outlet passage 224 may extend downward from intake passage 222 (e.g., rearward from or laterally-adjacent to front window 156) below air handler 216 and laterally along a bottom portion of peripheral frame 154 to a first air outlet 212 (e.g., below front window 156). As an additional or alternative example, a second outlet passage 226 may extend downward from intake passage 222 (e.g., directly above or in vertical alignment with a portion of front window 156) and laterally along a top portion of peripheral frame 154 to a second air outlet 214 (e.g., above front window 156).

Generally, air handler 216 is positioned downstream of air inlet 210. For instance, air handler 216 may be mounted within peripheral frame 154 upstream from the air outlets 212, 214 (e.g., within air intake passage 222). Air handler 216 may be provided as any suitable blower or fan (e.g., radial fan, tangential fan, etc.) positioned within outer casing 116 to actively rotate or motivate air therethrough. Air handler 216 may thus motivate an airflow from air inlet 210, through air intake passage 222, through air outlet passages 224, 226, and to the air outlets 212, 214 simultaneously.

In exemplary embodiments, air handler 216 includes one or more vertically-directed axial fans 286 mounted in a plane perpendicular to the vertical direction V, as shown in FIG. 6. In additional or alternative embodiments, air handler 216 includes one or more angled axial fans 288 mounted in a plane non-orthogonal to the vertical direction V, as shown in FIG. 8. As noted above, air handler 216 may optionally be provided as a plurality of laterally-spaced fans 286, 288. Thus, a plurality of vertically-directed or angled axial fans 286 or 288 may be provided within door 150.

In some embodiments, an internal wall 240 is positioned between front window 156 and one or both of the intake passage 222 or the air outlet passages 224, 226 along the transverse direction T (e.g., such that internal wall 240 separates front window 156 or image monitor 202 and outlet passages 224, 226). Advantageously, the airflow across internal wall 240 may convectively cool the door 150 and any electronic components therein (e.g., image monitor 202). Moreover, cooling may occur without passing the airflow directly across such electronic components.

In certain embodiments, one air outlet (e.g., curtain air outlet or first air outlet 212) is provided below front window 156. In particular, first air outlet 212 is defined through peripheral frame 154 at the front end 126. First air outlet 212 may be defined directly below front window 156. Thus, at least a portion of the airflow motivated by airflow motivated by air handler 216 may be directed from air inlet 210 to the ambient environment in front of outer casing 116 and front window 156 through first air outlet 212.

An airflow curtain path 242 is generally defined by first air outlet 212. In particular, airflow curtain path 242 may extend outward (e.g., in the transverse direction T) from door 150 in front of front window 156. Thus, air exhausted through first air outlet 212 is projected from door 150 along airflow curtain path 242, forming a curtain or blade of fast-moving air in front of door 150 (i.e., forward from door 150 along the transverse direction T). In certain embodiments, airflow curtain path 242 is defined to have a positive airflow angle between −45° and 45° with respect to (i.e., relative to) the transverse direction T (e.g., in a direction generally parallel to or away from cooktop appliance 300—FIG. 1). Thus, airflow curtain path 242 (and its associated curtain of air) extends from door 150 or peripheral frame 154 along the airflow angle.

During use, heat, steam, or exhaust fumes (e.g., as represented by arrows 246) generated at cooktop appliance 300 (or another location directly beneath first air outlet 212) may be advantageously blocked or restricted by the mass of air flowing along airflow curtain path 242. In turn, the visibility at imaging surface 204 may be preserved, while further protecting various electronic components (e.g., imagine monitor 202 or controller 510A—FIG. 2) of microwave appliance 110 from damage that may be caused by heat, steam, or exhaust fumes 246.

In some embodiments, the airflow angle is between 15° and 45° relative to transverse direction T. In other embodiments, the airflow angle is between −15° and 15°. In still other embodiments, the airflow angle is between −15° and −45° relative to transverse direction T.

Figure 4:
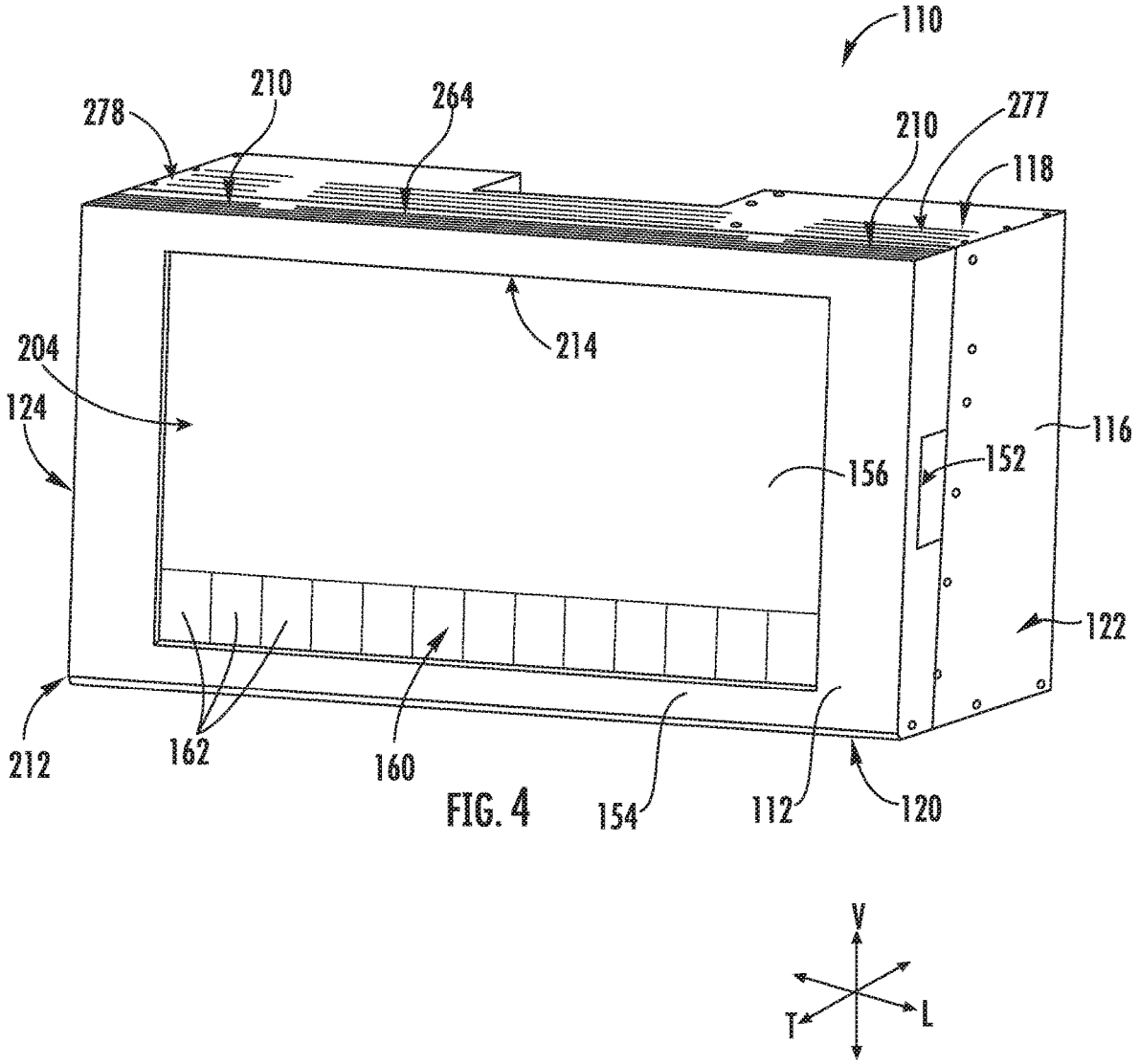
FIG. 4 provides a perspective view of a microwave appliance to exemplary embodiments of the present disclosure.
Figure 10:
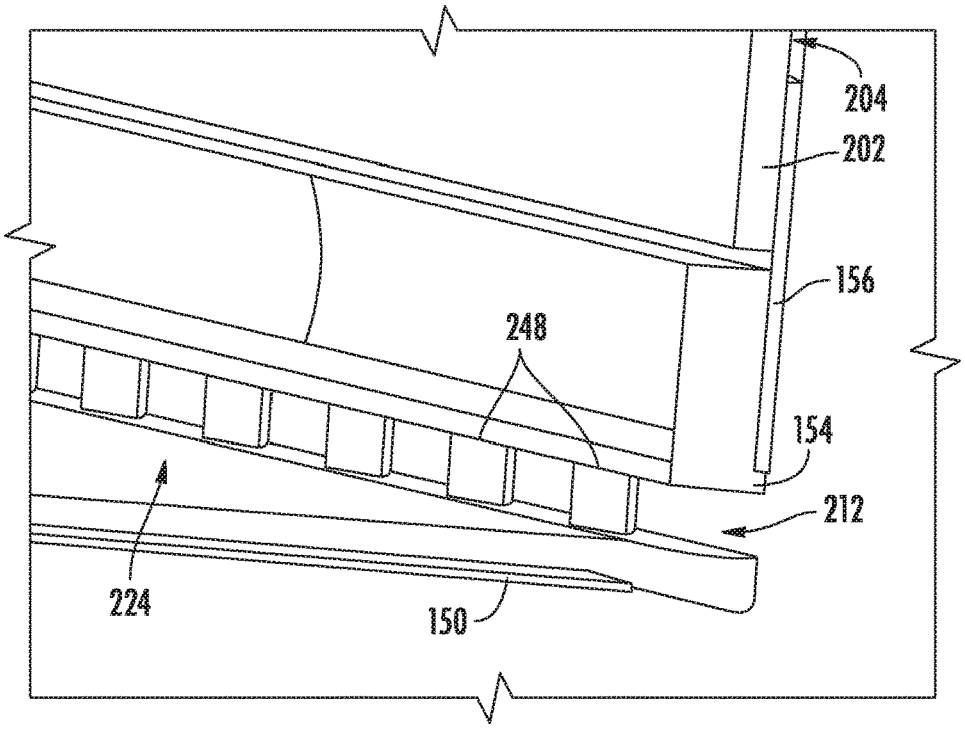
FIG. 10 provides an internal perspective view of a bottom portion of a microwave appliance according to exemplary embodiments of the present disclosure.

Turning briefly to FIG. 10, an internal perspective view is provided of first air outlet 212. As shown, one or more bottom guide vanes 248 may be provided within first air outlet 212. In particular, each bottom guide vane 248 may extend along the vertical direction V from a top to a bottom of first air outlet 212. In certain embodiments, multiple vanes of a plurality of bottom guide vanes 248 are spaced apart along the lateral direction L (FIG. 4). As air is motivated to first air outlet 212, the plurality of bottom guide vanes 248 may further direct the air (e.g., along the airflow curtain path 242—FIGS. 6 and 8) outward and away from door 150.

Returning generally to FIGS. 4 through 8, in certain embodiments, another air outlet (e.g., an upper or second air outlet 214) is defined through door 150. For instance, second air outlet 214 may be defined through at least a portion of peripheral frame 154 proximal to the top end 118. In particular, second air outlet 214 may be directed downward at the front end 126 of door 150 forward from front window 156. Along with being positioned forward from front window 156, second air outlet 214 may be positioned above front window 156. As illustrated, second air outlet 214 may define a coolant airflow path 250 along front window 156

(e.g., and imaging surface 204). Coolant airflow path 250 may extend from a position above front window 156 and therealong. Thus, at least a portion of the airflow motivated by air handler 216 may be directed from intake passage 222 and second outlet passage 226 to the ambient environment as it flows along front window 156. Optionally, coolant airflow path 250 may be defined parallel to front window 156, or otherwise at a nonparallel angle relative to the airflow angle of the airflow curtain path 242. Advantageously, the coolant airflow path 250 may draw heat from door 150 (e.g., at front window 156 or image monitor 202) in further prevent gas, fumes, or moisture from accumulating on front window 156.

Figure 9:
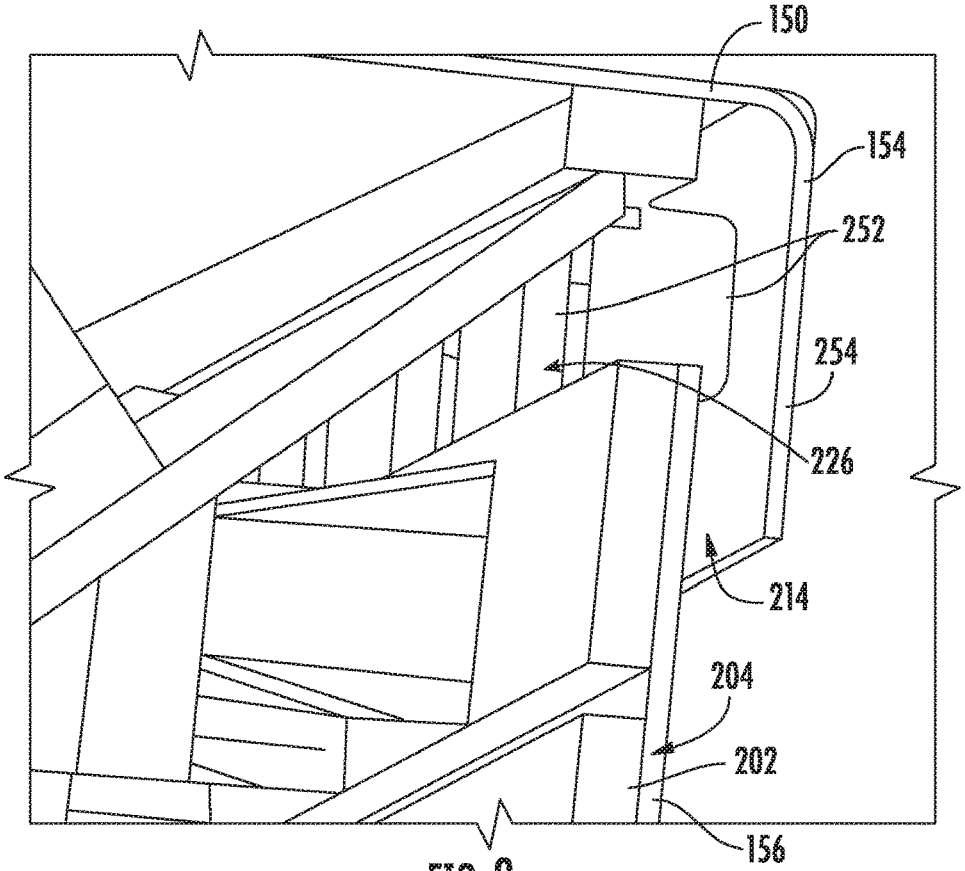
FIG. 9 provides an internal perspective view of a top portion of a microwave appliance according to exemplary embodiments of the present disclosure.

Turning briefly to FIG. 9, an internal perspective view is provided of second air outlet 214. As shown, one or more top guide vanes 252 may be provided within first air outlet 212. In particular, each top guide vane 252 may extend along the vertical direction V from a top to a bottom of second air outlet 214. In certain embodiments, multiple vanes of a plurality of top guide vanes 252 are spaced apart along the lateral direction L (FIG. 4). A lateral front plate 254 (e.g., formed from or as part of peripheral frame 154) may be positioned in front of top guide vanes 252. As air is motivated to second air outlet 214, the top plurality of guide vanes 248 and lateral front plate 254 may further direct the air downward and along front window 156 (e.g., along the coolant airflow path 250—FIGS. 6 and 8).

Returning again to FIGS. 4 through 8, in certain embodiments, an exhaust passage 258 is defined within outer casing 116. As shown, exhaust passage 258 may extend in fluid isolation from air intake passage 222 and air outlet passages 224, 226, as well as door 150 generally. An exhaust inlet 262 and an exhaust outlet 264 are defined in fluid communication with exhaust passage 258 (e.g., through one or more external walls of outer casing 116). In some embodiments, exhaust inlet 262 is defined through outer casing 116 proximal to the bottom end 120 (e.g., through a bottom wall or directly above cooktop surface 324—FIG. 2). In additional or alternative embodiments, exhaust outlet 264 is defined through outer casing 116 proximal to the top end 118 (e.g., through a top wall of outer casing 116). Optionally, exhaust outlet 264 may include a plurality of exhaust apertures, as shown in FIGS. 5 and 7. In additional or alternative embodiments, exhaust outlet 264 is positioned rearward from air inlet 210 along the transverse direction T (e.g., to restrict the flow of exhaust to the air inlet 210).

An exhaust air handler 266 may be mounted within exhaust passage 256. As would be understood, exhaust air handler 266 may be provided as any suitable blower or fan (e.g., radial fan, tangential fan, etc.) positioned within outer casing 116 to actively rotated or motivate air, steam, or exhaust fumes through exhaust passage 258. During use, the heat, steam, or exhaust fumes 246 may be motivated by exhaust air handler 266 from open region 130 (FIG. 2) to exhaust passage 258 through exhaust inlet 262 into exhaust outlet 264 (e.g., as indicated at arrows 268). Optionally, one or more filters (not pictured) may be provided at exhaust inlet 262 (e.g., between open region 130 and exhaust passage 258) to clean the air, steam, or exhaust fumes (e.g., at 246) as it enters outer casing 116. For instance, a grease filter having a suitable coarse filter medium, such as a metallic mesh including aluminum or stainless steel, may be mounted across exhaust inlet 262. Additionally or alternatively, an odor filter having a suitable fine filter medium, such as a mesh or block including activated carbon, may be mounted across exhaust inlet 262. Optionally, the odor filter may be positioned above or downstream from the grease filter.

As illustrated, at least a portion of exhaust passage 258 may be tapered downstream from exhaust air handler 266. For instance, an angled top plate 270 may be positioned proximate to top end 118 within exhaust passage 256. Angled top plate 270 may extend, for instance downward, from exhaust outlet 264, thereby reducing the cross-sectional area of exhaust passage 258 and accelerating the flow rate of air or exhaust gases (e.g., at 268) upstream of exhaust outlet 264. As air or exhaust gases flow from exhaust outlet 264, the accelerated flow rate induced by angled top plate 270 may advantageously prevent exhaust gases from flowing to air inlet 210.

In certain embodiments, a heat-exchange passage 280 is defined within outer casing 116 (e.g., above cooking chamber 114). As shown, heat-exchange passage 280 may extend separately from door 150 and in fluid isolation from air outlet passages 224, 226, as well as door 150 generally. Heat-exchange passage 280 may extend across an upper portion of cabinet 112 that houses at least a portion of the heating assembly 158 (e.g., including the magnetron). A heat-exchange inlet 277 may be defined through outer casing 116 (e.g., proximal the top end 118) upstream from heat-exchange passage 280 while a heat-exchange outlet 278 may be defined downstream from heat-exchange passage 280 (e.g., proximal the top end 118). For example, the heat-exchange inlet 277 and heat-exchange outlet 278 may be spaced apart from each other along the lateral direction L on top wall of outer casing 116. Optionally, heat-exchange inlet 277 or heat-exchange outlet 278 may include a plurality of apertures, as shown in FIGS. 5 and 7.

A heat-exchange air handler (not pictured) may be mounted within heat-exchange passage 280. As would be understood, the heat-exchange air handler may be provided as any suitable blower or fan (e.g., radial fan, tangential fan, etc.) positioned within outer casing 116 to actively rotated or motivate air through heat-exchange passage 280 separately from air handler 216 or air handler 266. During use, the heat-exchange air handler may thus motivate an airflow from the heat-exchange inlet 277, through heat-exchange passage 280, and to heat-exchange outlet 278.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A microwave appliance mountable over a cooktop appliance comprising a cooktop surface, the microwave appliance defining a vertical direction, a lateral direction, and a transverse direction, the microwave appliance comprising:

a cabinet extending in the lateral direction between a first side end and a second side end, the cabinet defining a cooking chamber;

a door movably mounted to the cabinet at the first side end or the second side end to move between an open position permitting access to the cooking chamber and a closed position restricting access to the cooking chamber, the door comprising a peripheral frame and a front window bounded by the peripheral frame, the peripheral frame defining an air inlet above the cooktop appliance and an air outlet downstream from the air inlet, the air outlet being defined below the front window along the vertical direction; and an air handler mounted within the door in fluid communication between the air inlet and the air outlet to motivate an airflow therethrough, wherein the air outlet defines an airflow curtain path extending outward from the cabinet relative to the transverse direction, the airflow curtain path further extending in front of the door relative to the transverse direction, wherein the air outlet is a first air outlet, wherein the peripheral frame further defines a second air outlet above the first air outlet, and wherein the second air outlet defines a coolant airflow path along the front window outside of the door.

2. The microwave appliance of claim 1, further comprising an image monitor supported on the door above the first air outlet and behind the front window.

3. The microwave appliance of claim 1, wherein the air inlet is defined through the door at a location forward from the cabinet.

4. The microwave appliance of claim 1, wherein the second air outlet is defined above the front window.

5. The microwave appliance of claim 1, wherein the second air outlet is defined between the peripheral frame and the front window.

6. The microwave appliance of claim 1, wherein the microwave appliance extends in the vertical direction from a top end to a bottom end, and wherein the air inlet is defined through the peripheral frame proximal to the top end.

7. The microwave appliance of claim 6, wherein the air handler comprises a plurality of axial fans spaced apart along the lateral direction.

8. The microwave appliance of claim 7, wherein the air handler is positioned within an intake air passage extending within the door above the front window.

9. The microwave appliance of claim 8, wherein the cabinet further defines an exhaust passage extending in fluid isolation from the intake air passage from an exhaust inlet proximal to the bottom end and an exhaust outlet proximal to the top end.

10. A microwave appliance mountable over a cooktop appliance comprising a cooktop surface, the microwave appliance defining a vertical direction, a lateral direction, and a transverse direction, the microwave appliance comprising:

a cabinet extending in the lateral direction between a first side end and a second side end, the cabinet defining a cooking chamber;

a door movably mounted to the cabinet in front of the cooking chamber to move between an open position permitting access to the cooking chamber and a closed position restricting access to the cooking chamber, the door comprising a peripheral frame and a front window bounded by the peripheral frame, the peripheral frame defining an air inlet, a first air outlet, and a second air outlet, the first air outlet being defined downstream from the air inlet and below the front window along the vertical direction, the second air outlet being defined downstream from the air inlet and above the first air outlet along the vertical direction; and an air handler mounted within the peripheral frame in fluid communication between the air inlet and the first air outlet to motivate an airflow therethrough, the air handler being mounted above the first air outlet, wherein the first air outlet defines an airflow curtain path extending outward from the cabinet relative to the transverse direction, the airflow curtain path further extending in front of the door relative to the transverse direction, and wherein the second air outlet defines a coolant airflow path extending from a position forward from the front window and therealong outside of the door.

11. The microwave appliance of claim 10, further comprising an image monitor supported on the door above the first and second air outlets and behind the front window.

12. The microwave appliance of claim 10, wherein the air inlet is defined through the peripheral frame at a location forward from the cabinet.

13. The microwave appliance of claim 10, wherein the second air outlet is defined above the front window.

14. The microwave appliance of claim 10, wherein the second air outlet is defined between the peripheral frame and the front window.

15. The microwave appliance of claim 10, wherein the microwave appliance extends in the vertical direction from a top end to a bottom end, and wherein the air inlet is defined through the peripheral frame proximal to the top end.

16. The microwave appliance of claim 15, wherein the air handler comprises a plurality of axial fans spaced apart along the lateral direction.

17. The microwave appliance of claim 16, wherein the air handler is positioned within an intake air passage extending within the door above the front window.

18. The microwave appliance of claim 17, wherein the cabinet further defines an exhaust passage extending in fluid isolation from the intake air passage from an exhaust inlet proximal to the bottom end and an exhaust outlet proximal to the top end.

* * * * *